US009805731B2

(12) United States Patent
Disch et al.

(10) Patent No.: US 9,805,731 B2
(45) Date of Patent: Oct. 31, 2017

(54) AUDIO BANDWIDTH EXTENSION BY INSERTION OF TEMPORAL PRE-SHAPED NOISE IN FREQUENCY DOMAIN

(71) Applicant: Fraunhofer-Gesellschaft zur Foerderung der angewandten Forschung e.V., Munich (DE)

(72) Inventors: Sascha Disch, Fuerth (DE); Markus Multrus, Nuremberg (DE); Benjamin Schubert, Nuremberg (DE); Markus Schnell, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/136,417

(22) Filed: Apr. 22, 2016

(65) Prior Publication Data

US 2016/0240200 A1 Aug. 18, 2016

Related U.S. Application Data

(63) Continuation of application No. PCT/EP2014/073375, filed on Oct. 30, 2014.

(30) Foreign Application Priority Data

Oct. 31, 2013 (EP) ..... 13191127

(51) Int. Cl.
*G10L 21/038* (2013.01)
*G10L 19/028* (2013.01)
(Continued)

(52) U.S. Cl.
CPC ..... *G10L 19/028* (2013.01); *G10L 19/0212* (2013.01); *G10L 19/167* (2013.01);
(Continued)

(58) Field of Classification Search
CPC ..... G10L 19/24; G10L 21/04; G10L 21/038
(Continued)

(56) References Cited

U.S. PATENT DOCUMENTS 8,532,983 B2 * 9/2013 Gao ..... G10L 21/038 704/200
8,532,998 B2 * 9/2013 Gao ..... G10L 21/038 704/200
(Continued)

FOREIGN PATENT DOCUMENTS

EP 1451812 A1 9/2004
EP 2228790 A2 9/2010
(Continued)

OTHER PUBLICATIONS

Bessette, B et al., "The Adaptive Multirate Wideband Speech Codec (AMR-WB)", IEEE Transactions on Speech and Audio Processing, IEEE Service Center. New York. vol. 10, No. 8., Nov. 2002, pp. 620-636.
(Continued)

*Primary Examiner* — Susan McFadden
(74) *Attorney, Agent, or Firm* — Perkins Coie, LLP; Michael A. Glenn

(57) ABSTRACT

An audio decoder device for decoding a bitstream includes a bitstream receiver configured to receive the bitstream and to derive an encoded audio signal from the bitstream; a core decoder module configured for deriving a decoded audio signal in a time domain from the encoded audio signal; a temporal envelope generator configured to determine a temporal envelope of the decoded audio signal; a bandwidth extension module configured to produce a frequency domain bandwidth extension signal; a time-to-frequency converter configured to transform the decoded audio signal into a frequency domain decoded audio signal; a combiner configured to combine the frequency domain decoded audio
(Continued)

signal and the frequency domain bandwidth extension signal in order to produce a bandwidth extended frequency domain audio signal; and a frequency-to-time converter configured to transform the bandwidth extended frequency domain audio signal into a bandwidth-extended time domain audio signal.

24 Claims, 4 Drawing Sheets

(51) Int. Cl.
*G10L 19/02* (2013.01)
*G10L 19/16* (2013.01)
*G10L 19/24* (2013.01)
*G10L 19/03* (2013.01)

(52) U.S. Cl.
CPC ..... *G10L 19/24* (2013.01); *G10L 21/038* (2013.01); *G10L 19/03* (2013.01)

(58) Field of Classification Search
USPC ..... 704/500
See application file for complete search history.

(56) References Cited

U.S. PATENT DOCUMENTS

| | | | | |
|---|---|---|---|---|
| 8,655,649 | B2 * | 2/2014 | Tsujino | G10L 19/06 704/205 |
| 9,064,500 | B2 * | 6/2015 | Tsujino | G10L 19/06 |
| 9,230,558 | B2 * | 1/2016 | Disch | G10L 21/04 |
| 9,236,062 | B2 * | 1/2016 | Disch | G10L 21/04 |
| 9,275,652 | B2 * | 3/2016 | Disch | G10L 21/04 |
| 9,460,734 | B2 * | 10/2016 | Tsujino | G10L 19/06 |
| 2006/0227018 | A1 | 10/2006 | Ejima et al. | |
| 2011/0054911 | A1 | 3/2011 | Baumgarte et al. | |
| 2012/0010880 | A1 | 1/2012 | Nagel et al. | |
| 2012/0136670 | A1 | 5/2012 | Ishikawa et al. | |

FOREIGN PATENT DOCUMENTS

| | | | |
|---|---|---|---|
| JP | H0936685 | A | 2/1997 |
| JP | 2005509928 | A | 4/2005 |
| JP | 2008096567 | A | 4/2008 |
| JP | 2010020356 | A | 1/2010 |
| JP | 2011034046 | A | 2/2011 |
| RU | 2011109670 | A | 9/2012 |
| WO | 2010115845 | A1 | 10/2010 |
| WO | 2011000780 | A1 | 1/2011 |

OTHER PUBLICATIONS

Dietz, M et al., "Spectral Band Replication, a Novel Approach in Audio Coding", Engineering Society Convention 121, Audio Engineering Society Paper 5553, May 10-13, 2002, pp. 1-8.

Disch, Sascha et al., "Cheap Beeps—Efficient Synthesis of Sinusoids and Sweeps in the MDCT Domain", 2013 IEEE International Conference on Acoustics, Speech and Signal Processing (ICASSP); Vancouver, BC; May 26-31, 2013, Institute of Electrical and Electronics Engineers, Piscataway, NJ, US, May 26, 2013, pp. 518-522.

Lei Miao T. et al., "HSTP-MCTB: Proposed Revised Text for the Media Coding Toolbox for IPTV: Audio and Video Codecs; C 855", ITU-T Draft; Study Period 2009-2012, International Telecommunication Union, Geneva, Switzerland, vol. 10/16, Apr. 17, 2012, pp. 1-64.

Miao, Lei, "G711.1 Annex D and G.722 Annex B—New ITU-T Superwideband CODECS", In the proceedings of ICASSP; Prague, Czech Republic, May 2011, pp. 5232-5235.

Taori, R. et al., "Hi-bin: An Alternative Approach to Wideband Speech Coding", Acoustics, Speech, and Signal Processing, 2000, ICASSP '00 Proceeding S. 2000 IEEE International Conference Jun. 5-9, 2000, Piscataway, NJ, USA, vol. 2, Jun. 5, 2000, pp. 1157-1160.

"ITU-T, G.729.1 International Telecommunication Union", g.729-Based embedded variable bit-rate coder: An 8-32 kbit/s scalable wideband coder bitstream interoperable with G.729, May 2006, 100 pages.

* cited by examiner

AUDIO BANDWIDTH EXTENSION BY INSERTION OF TEMPORAL PRE-SHAPED NOISE IN FREQUENCY DOMAIN

CROSS-REFERENCE TO RELATED APPLICATIONS

This application is a continuation of copending International Application No. PCT/EP2014/073375, filed Oct. 30, 2014, which is incorporated herein by reference in its entirety, and additionally claims priority from European Application No. 13 191 127.3, filed Oct. 31, 2013, which is incorporated herein by reference in its entirety.

The invention relates to speech and audio coding and particularly to audio bandwidth extension (BWE).

BACKGROUND OF THE INVENTION

Bandwidth extension techniques focus on enhancing the perceptible quality of an audio codec by widening its effective output bandwidth. Instead of coding the full bandwidth range with the underlying core coder, codecs using a bandwidth extension technique allow for less bit consumption in the perceptually less important higher frequency (HF) ranges. Thus, there are more bits available to the core coder processing the more important lower frequency (LF) range at a higher precision. For that reason, bandwidth extension techniques are commonly used in codecs, which need to realize proper perceptual quality at low bit rates.

In general, there are two different basic bandwidth extension approaches that need to be distinguished: Blind bandwidth extension and guided bandwidth extension. In a blind bandwidth extension, no additional side information is transmitted. Thus, the HF-content to be inserted on the decoder side is generated using only information derived from the decoded LF-signal of the core coder. Since a transmission of costly side information is not needed, Blind bandwidth extension techniques are well suited for codecs operating at lowest bit rates or for backward-compatible post-processing procedures. On the other hand, the lack of controllability only allows for a relatively small effective extension of bandwidth using a Blind bandwidth extension (e.g. 6.4-7.0 kHz in [1]). In contrast to the blind approach, in a guided bandwidth extension the HF-content is reconstructed using parameters, which are extracted at the encoder side and transmitted to the decoder as side information in the bitstream. Hence, a guided bandwidth extension enables a better control of the HF-reconstruction, rendering broader effective bandwidths possible. Due to the additional bit consumption, guided bandwidth extension techniques are commonly used for codecs operating at higher bit rates as systems incorporating a blind bandwidth extension.

More specifically, there are different methodologies for realizing a bandwidth extension:

In speech coding, usually source-filter model-based bandwidth extension methods are used, which are closely related to their underlying core coders, as e.g. in G.722.2 (AMR-WB) [1]. In AMR-WB, the output bandwidth of 6.4 kHz of the ACELP (algebraic code-excited linear prediction) core coder is extended to 7.0 kHz by injecting white noise into the excitation domain. Subsequently, the extended excitation is shaped by a filter derived from the core coder's linear prediction (LP) filter. Depending on the bit rate, the gain for scaling of the inserted noise is either estimated using only core coder information or it is extracted in the encoder and transmitted. This bandwidth extension method is heavily dependent to its underlying coding scheme, as it is using its synthesis mechanisms and thus additionally has to be performed in the same domain.

A well-known core coder independent bandwidth extension technique in audio coding is spectral band replication (SBR) [2]. In contrast to the previous example, spectral band replication can be applied independently from its underlying core coder. As a first step, the input signal is split into an LF- and an HF-part on encoder side, for example by using a quadrature mirror filter analysis filter bank (QMF). The LF-signal is fed to the core coder while the HF-part is processed by spectral band replication. Therefore, parameters describing the time-frequency-envelope of the HF-signal as well as the tonality/noisiness of the HF-signal relative to the LF-signal are extracted and transmitted. After decoding, the signal is transformed using the same type of analysis filter bank as used in the encoder. To reconstruct the HF-content, the decoded signal is copied, mirrored or transposed portion-wise to the HF-range, post-processed to match the tonality/noisiness of the original and shaped temporally as well as spectrally, considering the transmitted parameters. Subsequently, the time domain output signal is generated by a corresponding synthesis filter bank.

In contrast to the previously noted (semi-)parametrical methods there are also multiple layer approaches using multiple, bit rate selective layers for bandwidth extension. This principle is also closely related to scalable coding schemes. Those techniques are often used for extending existing coding systems in an interoperable manner. In [3] a super wideband (SWB) bandwidth extension for G.711.1 and G.722 is presented, which processes the additional bandwidth (8.0-14.4 kHz) with a modified discrete cosine transform (MDCT) based coding scheme independent from the core coder. This approach enables exact reconstruction of HF-parts, but at the expense of high bit consumption that be additionally used.

Although the above-mentioned bandwidth extension approaches are widely spread in present speech and audio coding systems, all of them reveal specific shortcomings or disadvantages, respectively.

SUMMARY

According to an embodiment, an audio decoder device for decoding a bitstream may have: a bitstream receiver configured to receive the bitstream and to derive an encoded audio signal from the bitstream; a core decoder module configured for deriving a decoded audio signal in time domain from the encoded audio signal; a temporal envelope generator configured to determine a temporal envelope of the decoded audio signal; a bandwidth extension module configured to produce a frequency domain bandwidth extension signal, wherein the bandwidth extension module includes a noise generator configured to produce a noise signal in time domain, wherein the bandwidth extension module includes a pre-shaping module configured for temporal shaping of the noise signal depending on the temporal envelope of the decoded audio signal in order to produce a shaped noise signal and wherein the bandwidth extension module includes a time-to-frequency converter configured to transform the shaped noise signal into a frequency domain noise signal, wherein the frequency domain bandwidth extension signal depends on the frequency domain noise signal; a time-to-frequency converter configured to transform the decoded audio signal into a frequency domain decoded audio signal; a combiner configured to combine the frequency domain decoded audio signal and the frequency domain bandwidth extension signal in order to produce a bandwidth extended frequency domain audio signal; and a frequency-to-time converter configured to transform the bandwidth extended frequency domain audio signal into a bandwidth-extended time domain audio signal.

According to another embodiment, a method for decoding a bitstream may have the steps of: receiving the bitstream and deriving an encoded audio signal from the bitstream using a bitstream receiver; deriving a decoded audio signal in a time domain from the encoded audio signal using a core decoder module; determining a temporal envelope of the decoded audio signal using a temporal envelope generator; producing a frequency domain bandwidth extension signal using a bandwidth extension module executing: producing a noise signal in time domain using a noise generator of the bandwidth extension module, temporal shaping of the noise signal depending on the temporal envelope of the decoded audio signal in order to produce a shaped noise signal using a pre-shaping module of the bandwidth extension module, transforming the shaped noise signal into a frequency domain noise signal; wherein the frequency domain bandwidth extension signal depends on the frequency domain noise signal, using a time-to-frequency converter of the bandwidth extension module; transforming the decoded audio signal into a frequency domain decoded audio signal using a further time-to-frequency converter; combining the frequency domain decoded audio signal and the frequency domain bandwidth extension signal in order to produce a bandwidth extended frequency domain audio signal using a combiner; and transforming the bandwidth extended frequency domain audio signal into a bandwidth-extended time domain audio signal using a frequency-to-time converter.

According to another embodiment, a non-transitory digital storage medium may have a computer program stored thereon to perform the inventive method when said computer program is run by a processor.

The invention provides a bandwidth extension concept, which can be basically applied independent from the underlying core coding technique. Furthermore, it offers a bandwidth extension up to super wideband frequency ranges for low bit rate operating points, with high perceptual quality especially for speech signals. This is achieved by generating temporally shaped noise signals in time domain, which are transformed and inserted to the frequency domain decoded audio signal.

The term frequency domain bandwidth extension signal refers to a signal comprising frequencies, which are not contained in the decoded audio signal.

In flexible, signal-adaptive systems incorporating more than one single core coder, e.g. as contained in the unified speech and audio coding (MPEG-D USAC), switching artifacts that occur at the transition between different core coders, might be emphasized as also the bandwidth extension has to be switched at the same time. These problems can be overcome by applying a core coder independent bandwidth extension technique according to the invention.

Spectral band replication introduces artifacts that might be annoying, especially when speech is coded due to the patching of LF-components to the HF-part. Those artifacts arise due to the correlation of LF- and patched HF-content, on the one hand. On the other hand, the possible spectral mismatch between LF- and HF-part leads to sharp sounding, inharmonic distortions. In contrast to that, the decoder device according to the invention avoids producing artifacts and sharp sounding.

Another shortcoming of spectral band replication is the restricted possibility to manipulate the temporal structure of the patched HF-part. Due to the need of a bit rate efficient parametric time-frequency-representation of the content, the temporal resolution is limited. This might be disadvantageous for e.g. processing female speech, where the pitch of the glottal pulses is high and also exhibits a high temporal variability. The decoder device according to the invention is, in contrast to spectral band replication, well suited for reproducing female speech.

Lastly, a bandwidth extension based on multiple layers is able to reconstruct HF-content in a both, spectrally and temporally exact manner, but on the other hand its bit consumption is significantly higher than for parametric approaches. The decoder device according to the invention provides lower bit consumption compelled to such approaches.

Thus, the present invention provides a new bandwidth extension concept, which combines the benefits of the well-known, previously described bandwidth extension techniques, while omitting their drawbacks. More specifically a concept is provided, that enables high quality, super wideband speech coding at low bit rates, while being independent from the underlying core coder.

The invention provides at high perceptual quality especially for speech for output bandwidths up to the super wideband range. The bandwidth extension according to the invention is based on noise insertion. Additionally, the new bandwidth extension is independent from its underlying core codec. Therefore, it is—in contrast to standard speech coding bandwidth extension suitable for being used on top of a switched system, incorporating fundamentally different coding schemes.

As the mixing of the newly proposed bandwidth extension's and the core decoder's signal is performed in a comparable time-frequency-representation to spectral band replication, both techniques could be easily combined in a combined system, where seamless switching on a frame-by-frame basis or blending within a given frame would be possible. As the new bandwidth extension focusses mainly on speech, this approach might be desirable for processing signals containing music or mixed content. Switching can be controlled either by transmitted side information or by parameters derived in the decoder by analyzing the core signal.

According to the invention, generation and subsequent shaping of noise is done in time domain, because in time domain temporal resolution may be higher than in solutions, in which noise is generated and shaped within a time-frequency-representation, similar to the one applied in spectral band replication processing, as the filter banks limit the time resolution, which is essential for reproducing high pitched (e.g. female) speech.

To avoid above mentioned problems and yet fulfill the requirements, the new bandwidth extension performs the following processing steps: First, a single noise signal is generated in time domain, where the number of samples arises from the system's frame rate as well as the chosen sampling rate and the noise signal's bandwidth. Subsequently, the noise signal is temporally pre-shaped, based on the temporal envelope of the decoded core coder's signal. Furthermore, the combined time-frequency-represented signal is converted to the bandwidth extended time domain audio signal by inverse transformation.

Bandwidth extension techniques are commonly used in speech and audio coding for enhancing the perceptual quality by widening the effective output bandwidth. Thus the majority of available bits can be used within the core coder, enabling a higher precision in the more important lower frequency range. Although there are existing approaches, some of which gained wide acceptance, they all lack of viability for speech processing by a system which incorporates multiple, switchable core coders, based on different coding schemes. As the bandwidth extension according to the invention is independent from the core decoder technology, the present invention proposes a bandwidth extension technique, which is perfectly suited to the above-mentioned application and others.

Within the bandwidth extension according to the invention, fully synthetic extension signals may be generated having a temporal envelope that can be pre-shaped, and thereby adapted to the underlying core coder signal. Shaping of the temporal envelope of the extension signal can be done in a significantly higher time resolution than it is available within the genuine filter bank or transform domain employed in the bandwidth extension post-shaping process.

According to an advantageous embodiment of the invention is the frequency domain bandwidth extension signal produced without spectral band replication. By these features a computational effort involved may be minimized.

According to an advantageous embodiment of the invention the bandwidth extension module is configured in such way, that the temporal shaping of the noise signal is done in an overemphasized manner. Instead of shaping the noise signal based on the original temporal envelope of the decoded audio signal; it is also possible to perform this shaping in an overemphasized manner. This can be realized by spreading the temporal envelope in terms of amplitudes, in other words by dynamic expansion, in particular by modifying the measured envelope to represent pulses much sharper than have been measured, before deriving pre-shaping gains on its basis. Although this overemphasis does not represent the actual original envelope, the intelligibility of some signal portions, like e.g. vowels, improves for very low bitrates.

According to an advantageous embodiment of the invention the bandwidth extension module is configured in such way, that the temporal shaping of the noise signal is done subband-wise by splitting the noise signal into several subband noise signals by a bank of band pass filters and performing a specific temporal shaping on each of the subband noise signals.

Instead of pre-shaping the noise signal uniformly, the shaping can be made more precisely by splitting the noise signal into several subbands by a bank of band pass filters and performing a specific shaping on every subband signal.

According to an advantageous embodiment of the invention the bandwidth extension module comprises a frequency range selector configured for setting a frequency range of the frequency domain bandwidth extension signal. After transforming the shaped noise signal into a time-frequency-representation, the targeted bandwidth of the bandwidth extended frequency-domain audio signal may be selected and, if need be, shifted to its intended, spectral position. By these features the frequency range of the bandwidth-extended time domain audio signal may be chosen in an easy way.

According to an advantageous embodiment of the invention comprises the bandwidth extension module a post-shaping module configured for temporal and/or spectral shaping in frequency domain of the frequency domain bandwidth extension signal. By these features the frequency domain bandwidth extension signal may be adapted with respect to an additional temporal trend and/or a spectral envelope for refinement.

According to an advantageous embodiment of the invention the bitstream receiver is configured to derive a side information signal from the bitstream, wherein the bandwidth extension module is configured to produce the frequency domain bandwidth extension signal depending on the side information signal. With other words, additional side information, which was extracted within the encoder and transmitted via the bitstream, may be applied for further refinement of the frequency domain bandwidth extension signal. By these features the perceived quality of the bandwidth-extended time domain audio signal may be further increased.

According to an advantageous embodiment of the invention the noise generator is configured to produce the noise signal depending on the side information signal. In this embodiment the noise generator can be controlled in a way to obtain a noise signal with a spectral tilt, instead of spectrally flat white noise, in order to further improve the perceived quality of the bandwidth-extended time domain audio signal.

According to an advantageous embodiment of the invention the pre-shaping module is configured for temporal shaping of the noise signal depending on the side information signal. Within the pre-shaping, side information can be used to e.g. choose a certain target bandwidth of the core decoder signal, which is used for pre-shaping.

According to an advantageous embodiment of the invention the post shaping module is configured for temporal and/or the spectral shaping of the frequency domain output noise signal depending on the side information signal. Using side information in the post-shaping may ensure that the coarse time-frequency-envelope of the frequency domain bandwidth extension signal follows the original envelope.

According to an advantageous embodiment of the invention the bandwidth extension module comprises a further noise generator configured to produce a further noise signal in a time domain, a further pre-shaping module configured for temporal shaping of the further noise signal depending on the temporal envelope of the decoded audio signal in order to produce a further shaped noise signal and a further time-to-frequency converter configured to transform the further shaped noise signal into a further frequency domain noise signal; wherein the frequency domain bandwidth extension signal depends on the further frequency domain noise signal. Producing the frequency domain bandwidth extension signal using two or more frequency domain noise signals may lead to an increase of the perceived quality of the bandwidth-extended time domain audio signal.

According to an advantageous embodiment of the invention the bandwidth extension module is configured in such way, that the temporal shaping of the further noise signal is done in an overemphasized manner. Instead of shaping the further noise signal based on the original temporal envelope of the decoded audio signal; it is also possible to perform this shaping in an overemphasized manner. This can be realized by spreading the temporal envelope in terms of amplitudes, before deriving pre-shaping gains on its basis. Although this overemphasis does not represent the actual original envelope, the intelligibility of some signal portions, like e.g. vowels, improves for very low bitrates.

According to an advantageous embodiment of the invention the bandwidth extension module is configured in such way, that the temporal shaping of the further noise signal is done subband-wise by splitting the further noise signal into several further subband noise signals by a bank of band pass filters and performing a specific temporal shaping on each of the further subband noise signals.

Instead of pre-shaping the further noise signal uniformly, the shaping can be made more precisely by splitting the further noise signal into several subbands by a bank of band pass filters and performing a specific shaping on every subband signal.

According to an advantageous embodiment of the invention the bandwidth extension module comprises a tone generator configured to produce a tone signal in a time domain, a pre-shaping module configured for temporal shaping of the tone signal depending on the temporal envelope of the decoded audio signal in order to produce a shaped tone signal and a time-to-frequency converter configured to transform the shaped tone signal into a frequency domain tone signal, wherein the frequency domain bandwidth extension signal depends on the frequency domain tone signal.

Said tone generator may be functional to produce all kinds of tones, e.g. sine tones, triangle and square wave tones, saw tooth tones, pulses that resemble artificial voiced speech, etc. Additional to processing synthetic noise signals, it is also possible to generate synthetic tonal components in time domain that are temporal shaped and subsequently transformed into a frequency representation. In this case, shaping in time domain is beneficial e.g. for modeling precisely the ADSR (attack, decay, sustain, release) phases of tones, which is not possible in a common frequency domain representation. The additionally use of a frequency domain tone signal may further increase the quality of the bandwidth extended time domain signal.

According to an advantageous embodiment of the invention the core decoder module comprises a time domain core decoder and a frequency domain core decoder, wherein either the time domain core decoder or the frequency domain core decoder is used for deriving the decoded audio signal from the encoded audio signal. These features allow using the invention in a unified speech and audio coding (MPEG-D USAC) environment.

According to an advantageous embodiment of the invention a control parameter extractor is configured for extracting control parameters used by the core decoder module from the decoded audio signal and wherein the bandwidth extension module is configured to produce the frequency domain bandwidth extension signal depending on the control parameters. Although the frequency domain bandwidth extension signal may be produced blindly on the basis of the core coder envelope or controlled by parameters derived from the core coder signal, it can also be produced in a partly guided way, by means of extracted and transmitted parameters from the encoder.

According to an advantageous embodiment of the invention the bandwidth extension module comprises a shaping gains calculator configured for establishing shaping gains for the pre-shaping module depending on the temporal envelope of the decoded audio signal and wherein the pre-shaping module is configured for temporal shaping of the noise signal depending on the shaping gains for the pre-shaping module. These features allow implementing the invention in an easy way.

According to an advantageous embodiment of the invention the shaping gains calculator for establishing shaping gains for the pre-shaping module is configured for establishing shaping gains for the pre-shaping module depending on the control parameters. These features allow implementing the invention in an easy way.

According to an advantageous embodiment of the invention the bandwidth extension module comprises a shaping gains calculator configured for establishing shaping gains for the further pre-shaping module depending on the temporal envelope of the decoded audio signal and wherein the further pre-shaping module is configured for temporal shaping of the further noise signal depending on the shaping gains for the further pre-shaping module.

According to an advantageous embodiment of the invention the shaping gains calculator for establishing shaping gains for the further pre-shaping module is configured for establishing shaping gains for the further pre-shaping module depending on the control parameters.

According to an advantageous embodiment of the invention the bandwidth extension module comprises a shaping gains calculator configured for establishing shaping gains for the tone pre-shaping module depending on the temporal envelope of the decoded audio signal and wherein the tone pre-shaping module is configured for temporal shaping of the tone signal depending on the shaping gains for the tone pre-shaping module.

According to an advantageous embodiment of the invention the shaping gains calculator for establishing shaping gains for the tone pre-shaping module is configured for establishing shaping gains for the further pre-shaping module depending on the control parameters.

In a further aspect the object is achieved by a method for decoding a bitstream, wherein the method comprises the steps of:

receiving the bitstream and deriving an encoded audio signal from the bitstream using a bitstream receiver;

deriving a decoded audio signal in a time domain from the encoded audio signal using a core decoder module;

determining a temporal envelope of the decoded audio signal using a temporal envelope generator;

producing a frequency domain bandwidth extension signal using a bandwidth extension module executing the steps of:

producing a noise signal in time domain using a noise generator of the bandwidth extension module, temporal shaping of the noise signal depending on the temporal envelope of the decoded audio signal in order to produce a shaped noise signal using a pre-shaping module of the bandwidth extension module, transforming the shaped noise signal into a frequency domain noise signal; wherein the frequency domain bandwidth extension signal depends on the frequency domain noise signal, using a time-to-frequency converter of the bandwidth extension module;

transforming the decoded audio signal into a frequency domain decoded audio signal using a further time-to-frequency converter;

combining the frequency domain decoded audio signal and the frequency domain bandwidth extension signal in order to produce a bandwidth extended frequency domain audio signal using a combiner; and transforming the bandwidth extended frequency domain audio signal into a bandwidth-extended time domain audio signal using a frequency-to-time converter.

In a further aspect the object is achieved by a computer program executing the inventive method when running on a processor.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
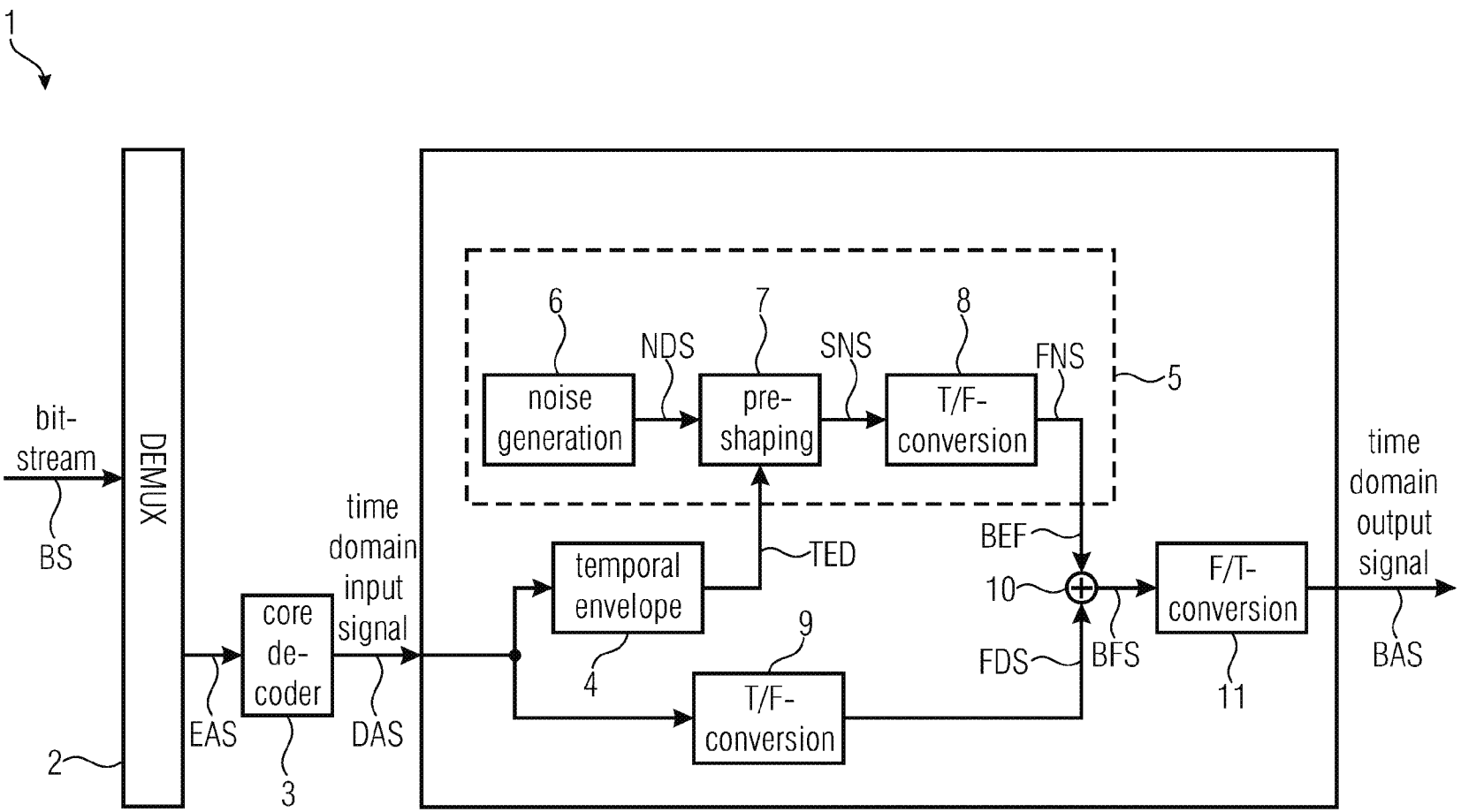
FIG. 1 illustrates a first embodiment of an audio decoder device according to the invention in a schematic view.

FIG. 1 illustrates a first embodiment of an audio decoder device according to the invention in a schematic view.

The audio decoder device 1 comprises:

a bitstream receiver 2 configured to receive the bitstream BS and to derive an encoded audio signal EAS from the bitstream BS;

a core decoder module 3 configured for deriving a decoded audio signal DAS in time domain from the encoded audio signal EAS;

a temporal envelope generator 4 configured to determine a temporal envelope TED of the decoded audio signal DAS;

a bandwidth extension module 5 configured to produce a frequency domain bandwidth extension signal BEF, wherein the bandwidth extension module 5 comprises a noise generator 6 configured to produce a noise signal NOS in time domain, wherein the bandwidth extension module 5 comprises a pre-shaping module 7 configured for temporal shaping of the noise signal NOS depending on the temporal envelope TED of the decoded audio signal DAS in order to produce a shaped noise signal SNS and wherein the bandwidth extension module comprises 5 a time-to-frequency converter 8 configured to transform the shaped noise signal SNS into a frequency domain noise signal FNS, wherein the frequency domain bandwidth extension signal BEF depends on the frequency domain noise signal FNS;

a time-to-frequency converter 9 configured to transform the decoded audio signal DAS into a frequency domain decoded audio signal FDS;

a combiner 10 configured to combine the frequency domain decoded audio signal FDS and the frequency domain bandwidth extension signal BEF in order to produce a bandwidth extended frequency domain audio signal BFS; and a frequency-to-time converter 11 configured to transform the bandwidth extended frequency domain audio signal BFS into a bandwidth-extended time domain audio signal BAS.

The invention provides a bandwidth extension concept, which can be basically applied independent from the underlying core coding technique. Furthermore, it offers a bandwidth extension up to super wideband frequency ranges for low bit rate operating points, with high perceptual quality especially for speech signals. This is achieved by generating temporally shaped noise signals SNS in time domain, which are transformed and inserted to the frequency domain decoded audio signal FDS.

In flexible, signal-adaptive systems incorporating more than one single core coder, e.g. as contained in the unified speech and audio coding (MPEG-D USAC), switching artifacts that occur at the transition between different core coders, might be emphasized as also the bandwidth extension has to be switched at the same time. These problems can be overcome by applying a core coder independent bandwidth extension technique according to the invention.

Spectral band replication introduces artifacts that might be annoying, especially when speech is coded due to the patching of LF-components to the HF-part. Those artifacts arise due to the correlation of LF- and patched HF-content, on the one hand. On the other hand, the possible spectral mismatch between LF- and HF-part leads to sharp sounding, inharmonic distortions. In contrast to that, the decoder device 1 according to the invention avoids producing artifacts and sharp sounding.

Another shortcoming of spectral band replication is the lack of possibility to manipulate the temporal structure of the patched HF-part. Due to the need of a bit rate efficient parametric time-frequency-representation of the content, the temporal resolution is limited. This might be disadvantageous for e.g. processing female speech, where the pitch of the glottal pulses is high and also exhibits a high temporal variability. The decoder device 1 according to the invention is, in contrast to spectral band replication, well suited for reproducing female speech.

Lastly, a bandwidth extension based on multiple layers is able to reconstruct HF-content in a both, spectrally and temporally exact manner, but on the other hand its bit consumption is significantly higher than for parametric approaches. The decoder device 1 according to the invention provides lower bit consumption compelled to such approaches.

Thus, the present invention provides a new bandwidth extension concept, which combines the benefits of the well-known, previously described bandwidth extension techniques, while omitting their drawbacks. More specifically a concept is provided, that enables high quality, super wideband speech coding at low bit rates, while being independent from the underlying core coder 3.

The invention provides at high perceptual quality especially for speech for output bandwidths up to the super wideband range. The bandwidth extension according to the invention is based on noise insertion. Additionally, the new bandwidth extension is independent from its underlying core codec. Therefore, it is—in contrast to standard speech coding bandwidth extension suitable for being used on top of a switched system, incorporating fundamentally different coding schemes.

As the mixing of the newly proposed bandwidth extension's and the core decoder's signal is performed in a comparable time-frequency-representation to spectral band replication, both techniques could be easily combined in a combined system, where seamless switching on a frame-by-frame basis or blending within a given frame would be possible. As the new bandwidth extension focusses mainly on speech, this approach might be desirable for processing signals containing music or mixed content. Switching can be controlled either by transmitted side information or by parameters derived in the decoder 3 by analyzing the core signal DAS.

According to the invention, generation and subsequent shaping of noise is done in time domain, because in time domain temporal resolution may be higher than in solutions, in which noise is generated and shaped within a time-frequency-representation, similar to the one applied in spectral band replication processing, as the filter banks limit the time resolution, which is essential for reproducing high pitched (e.g. female) speech.

To avoid above mentioned problems and yet fulfill the requirements, the new bandwidth extension performs the following processing steps: First, a single noise signal NOS is generated in time domain, where the number of samples arises from the system's frame rate as well as the chosen sampling rate and the noise signal's bandwidth. Subsequently, the noise signal NOS is temporally pre-shaped, based on the temporal envelope TED of the decoded core coder's signal DAS. Furthermore, the combined time-frequency-represented signal BFS is converted to the bandwidth extended time domain audio signal BAS by inverse transformation.

Bandwidth extension techniques are commonly used in speech and audio coding for enhancing the perceptual quality by widening the effective output bandwidth. Thus the majority of available bits can be used within the core coder 3, enabling a higher precision in the more important lower frequency range. Although there are existing approaches, some of which gained wide acceptance, they all lack of viability for speech processing by a system which incorporates multiple, switchable core coders, based on different coding schemes. As the bandwidth extension according to the invention is independent from the core decoder technology, the present invention proposes a bandwidth extension technique, which is perfectly suited to the above-mentioned application and others.

Within the bandwidth extension according to the invention, fully synthetic extension signals may be generated having a temporal envelope that can be pre-shaped, and thereby adapted to the underlying core coder signal DAS. Shaping of the temporal envelope of the extension signal SNS can be done in a significantly higher time resolution than it is available within the genuine filter bank or transform domain employed in the bandwidth extension post-shaping process.

According to an advantageous embodiment of the invention the frequency domain bandwidth extension signal BEF is produced without spectral band replication. By these features a computational effort involved may be minimized.

According to an advantageous embodiment of the invention the bandwidth extension module 5 is configured in such way that the temporal shaping of the noise signal NOS is done in an overemphasized manner. Instead of shaping the noise signal NOS based on the original temporal envelope TED of the decoded audio signal DAS; it is also possible to perform this shaping in an overemphasized manner. This can be realized by spreading the temporal envelope TED in terms of amplitudes, before deriving pre-shaping gains on its basis. Although this overemphasis does not represent the actual original envelope TED, the intelligibility of some signal portions, like e.g. vowels, improves for very low bitrates.

According to an advantageous embodiment of the invention the bandwidth extension module 5 is configured in such way that the temporal shaping of the noise signal NOS is done subband-wise by splitting the noise signal NOS into several subband noise signals by a bank of band pass filters and performing a specific temporal shaping on each of the subband noise signals.

Instead of pre-shaping the noise signal NOS uniformly, the shaping can be made more precisely by splitting the noise signal NOS into several subbands by a bank of band pass filters and performing a specific shaping on every subband signal.

Furthermore, the invention relates to a method for decoding a bitstream BS, wherein the method comprises the steps of:

receiving the bitstream BS and deriving an encoded audio signal EAS from the bitstream BS using a bitstream receiver 2;

deriving a decoded audio signal DAS in a time domain from the encoded audio signal EAS using a core decoder module 3;

determining a temporal envelope TED of the decoded audio signal DAS using a temporal envelope generator 4;

producing a frequency domain bandwidth extension signal BEF using a bandwidth extension module 5 executing the steps of:

producing a noise signal NOS in time domain using a noise generator 6 of the bandwidth extension module 5, temporal shaping of the noise signal NOS depending on the temporal envelope TED of the decoded audio signal DAS in order to produce a shaped noise signal SNS using a pre-shaping module 7 of the bandwidth extension module 5, transforming the shaped noise signal SNS into a frequency domain noise signal FNS; wherein the frequency domain bandwidth extension signal BEF depends on the frequency domain noise signal FNS, using a time-to-frequency converter 8 of the bandwidth extension module 5;

transforming the decoded audio signal DAS into a frequency domain decoded audio signal FDS using a further time-to-frequency converter 9;

combining the frequency domain decoded audio signal FDS and the frequency domain bandwidth extension signal BEF in order to produce a bandwidth extended frequency domain audio signal BFS using a combiner 10; and transforming the bandwidth extended frequency domain audio signal BFS into a bandwidth-extended time domain audio signal BAS using a frequency-to-time converter 11.

Moreover, the invention relates to the computer program, when running on a processor, executing the method according to the invention.

Figure 2:
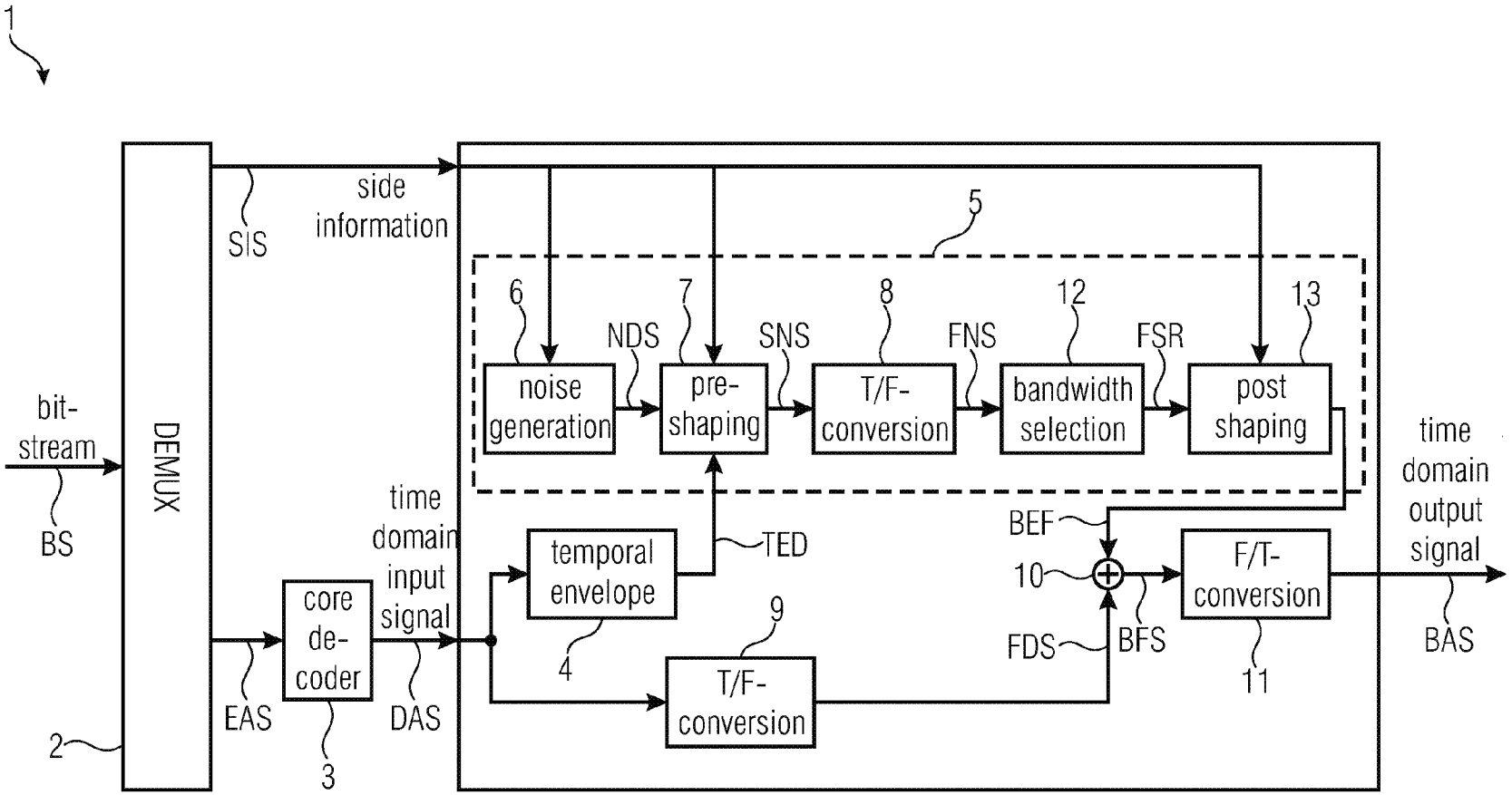
FIG. 2 illustrates a second embodiment of an audio decoder device according to the invention in a schematic view.

FIG. 2 illustrates a second embodiment of an audio decoder device according to the invention in a schematic view.

According to an advantageous embodiment of the invention the bandwidth extension module 5 comprises a frequency range selector 12 configured for setting a frequency range of the frequency domain bandwidth extension signal BEF. After transforming the shaped noise signal SNS into a time-frequency-representation FNS, the targeted bandwidth of the bandwidth extended frequency-domain audio signal BEF may be selected and, if need be, shifted to its intended, spectral position. By these features the frequency range of the bandwidth-extended time domain audio signal BAS may be chosen in an easy way.

According to an advantageous embodiment of the invention the bandwidth extension module 5 comprises a post-shaping module configured for temporal and/or spectral shaping in frequency domain of the frequency domain bandwidth extension signal BEF. By these features the frequency domain bandwidth extension signal BEF may be adapted with respect to an additional temporal trend and/or a spectral envelope for refinement.

According to an advantageous embodiment of the invention the bitstream receiver 2 is configured to derive a side information signal SIS from the bitstream BS, wherein the bandwidth extension module 5 is configured to produce the frequency domain bandwidth extension signal BEF depending on the side information signal SIS. With other words, additional side information, which was extracted within the encoder and transmitted via the bitstream BS, may be applied for further refinement of the frequency domain bandwidth extension signal BEF. By these features the perceived quality of the bandwidth-extended time domain audio signal BAS may be further increased.

According to an advantageous embodiment of the invention the noise generator 6 is configured to produce the noise signal NOS depending on the side information signal SIS. In this embodiment the noise generator 6 can be controlled in a way to obtain a noise signal with a spectral tilt, instead of spectrally flat white noise, in order to further improve the perceived quality of the bandwidth-extended time domain audio signal BAS.

According to an advantageous embodiment of the invention the pre-shaping module 7 is configured for temporal shaping of the noise signal NOS depending on the side information signal SIS. Within the pre-shaping, side information can be used to e.g. choose a certain target bandwidth of the core decoder signal DAS, which is used for pre-shaping.

According to an advantageous embodiment of the invention the post-shaping module 13 is configured for temporal and/or the spectral shaping of the frequency domain bandwidth extension signal BEF depending on the side information signal SIS. Using side information in the post-shaping may ensure that the coarse time-frequency-envelope of the frequency domain bandwidth extension signal BEF follows the original envelope TED.

Figure 3:
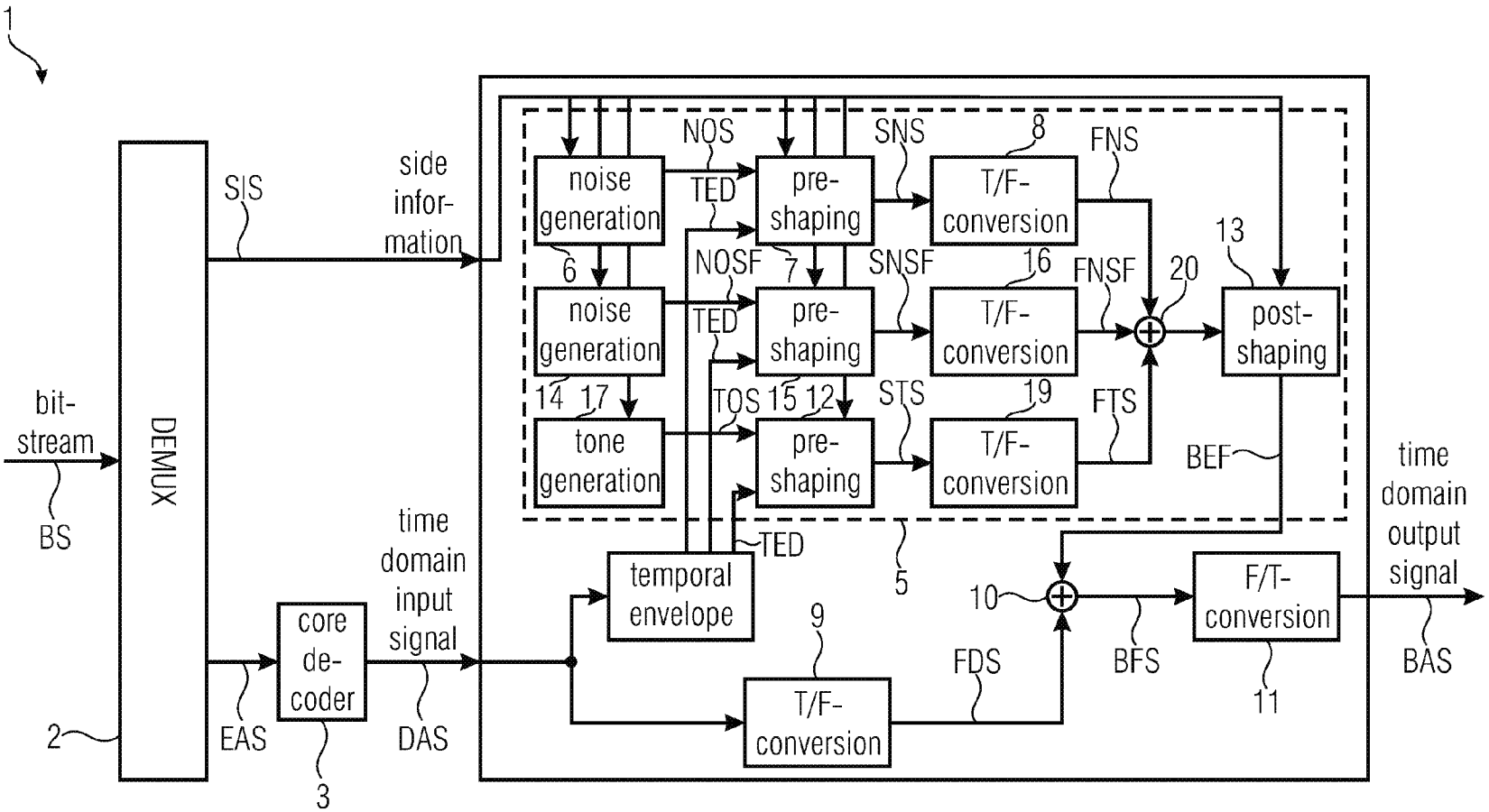
FIG. 3 illustrates a third embodiment of an audio decoder device according to the invention in a schematic view.

FIG. 3 illustrates a third embodiment of an audio decoder device according to the invention in a schematic view.

According to an advantageous embodiment of the invention the bandwidth extension module 5 comprises a further noise generator 14 configured to produce a further noise signal NOSF in time domain, a further pre-shaping module 15 configured for temporal shaping of the further noise signal NOSF depending on the temporal envelope TED of the decoded audio signal DAS in order to produce a further shaped noise signal SNSF and a further time-to-frequency converter 16 configured to transform the further shaped noise signal SNSF into a further frequency domain noise signal FNSF, wherein the frequency domain bandwidth extension signal BEF depends on the further frequency domain noise signal FNSF. Producing the frequency domain bandwidth extension signal BEF using two frequency domain noise signals FNS, FNSF may lead to an increase of the perceived quality of the bandwidth-extended time domain audio signal BAS.

According to an advantageous embodiment of the invention the bandwidth extension module 5 is configured in such way that the temporal shaping of the further noise signal NOSF is done in an overemphasized manner. This can be realized by spreading the temporal envelope in terms of amplitudes, before deriving pre-shaping gains on its basis. Although this overemphasis does not represent the actual original envelope, the intelligibility of some signal portions, like e.g. vowels, improves for very low bitrates.

According to an advantageous embodiment of the invention the bandwidth extension module 5 is configured in such way that the temporal shaping of the further noise signal NOSF is done subband-wise by splitting the further noise signal NOSF into several further subband noise signals by a bank of band pass filters and performing a specific temporal shaping on each of the further subband noise signals.

Instead of pre-shaping the further noise signal uniformly, the shaping can be made more precisely by splitting the further noise signal into several subbands by a bank of band pass filters and performing a specific shaping on every subband signal.

According to an advantageous embodiment of the invention the bandwidth extension module 5 comprises a tone generator 17 configured to produce a tone signal TOS in a time domain, a tone pre-shaping module 18 configured for temporal shaping of the tone signal TOS depending on the temporal envelope TED of the decoded audio signal DAS in order to produce a shaped tone signal STS and a time-to-frequency converter 19 configured to transform the shaped tone signal STS into a frequency domain tone signal FTS, wherein the frequency domain bandwidth extension signal BEF depends on the frequency domain tone signal FTS. Additional to processing synthetic noise signals NOS, NOSF, it is also possible to generate synthetic tonal components in time domain that are temporal shaped and subsequently transformed into a frequency representation FTS. In this case, shaping in time domain is beneficial e.g. for modeling precisely the ADSR (attack, decay, sustain, release) phases of tones, which is not possible in a common frequency domain representation. The additionally use of a frequency domain tone signal FTS may further increase the quantity of the bandwidth extended time domain signal BAS.

The frequency domain noise signal FNS, the further frequency domain signal FNSF and/or the frequency domain tone signal may be combined by a combiner 20.

Figure 4:
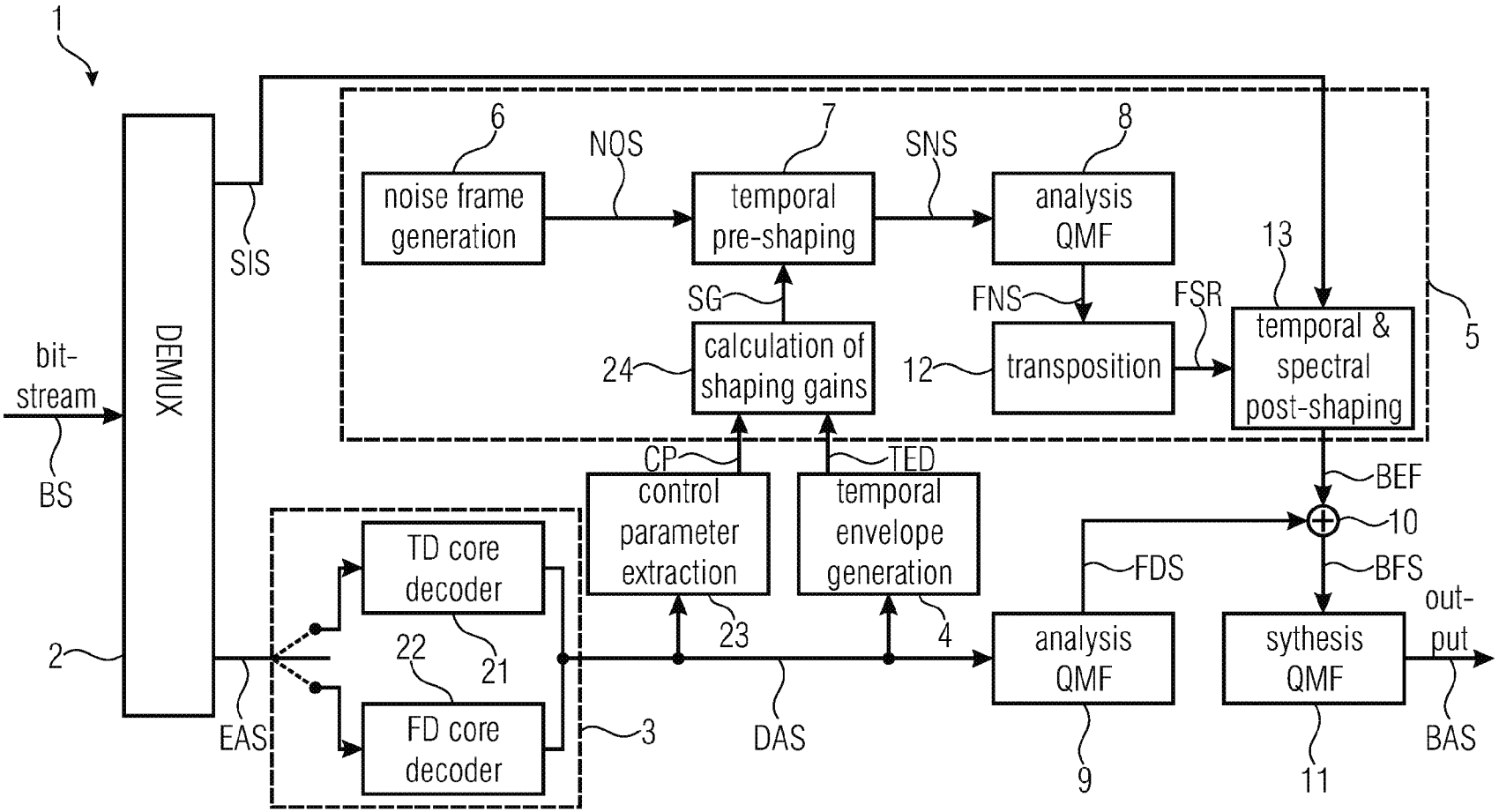
FIG. 4 illustrates a forth embodiment of an audio decoder device according to the invention in a schematic view.

FIG. 4 illustrates a forth embodiment of an audio decoder device ac-cording to the invention in a schematic view.

According to an advantageous embodiment of the invention the core decoder module 5 comprises a time domain core decoder 21 and a frequency domain core decoder 22, wherein either the time domain core decoder 21 or the frequency domain core decoder 22 is selectable for deriving the decoded audio signal DAS from the encoded audio signal EAS.

These features allow using the invention t in a unified speech and audio coding (MPEG-D USAC) environment.

According to an advantageous embodiment of the invention a control parameter extractor 23 is configured for extracting control parameters CP used by the core decoder module 3 from the decoded audio signal DAS and wherein the bandwidth extension module 5 is configured to produce the frequency domain bandwidth extension signal BEF depending on the control parameters CP. Although the frequency domain bandwidth extension signal BEF may be produced blindly on the basis of the core coder envelope or controlled by parameters derived from the core coder signal, it can also be produced in a partly guided way, by means of extracted and transmitted parameters from the encoder.

According to an advantageous embodiment of the invention the bandwidth extension module 5 comprises a shaping gains calculator 24 configured for establishing shaping gains SG for the pre-shaping module 7 depending on the temporal envelope TED of the decoded audio signal DAS and wherein the pre-shaping module 7 is configured for temporal shaping of the noise signal NOS depending on the shaping gains SG for the pre-shaping module 7. These features allow implementing the invention in an easy way.

According to an advantageous embodiment of the invention the shaping gains calculator 24 for establishing shaping gains SG for the pre-shaping module 7 is configured for establishing shaping gains SG for the pre-shaping module 7 depending on the control parameters CP.

According to an advantageous embodiment of the invention the bandwidth extension module 5 comprises a shaping gains calculator configured for establishing shaping gains for the further pre-shaping module 15 depending on the temporal envelope TED of the decoded audio signal DAS and wherein the further pre-shaping module 14 is configured for temporal shaping of the further noise signal NOSF depending on the shaping gains for the further pre-shaping module 14.

According to an advantageous embodiment of the invention the shaping gains calculator for establishing shaping gains for the further pre-shaping module 15 is configured for establishing shaping gains for the further pre-shaping module 15 depending on the control parameters CP.

According to an advantageous embodiment of the invention the bandwidth extension module 5 comprises a shaping gains calculator configured for establishing shaping gains for the tone pre-shaping module 18 depending on the temporal envelope TED of the decoded audio signal DAS and wherein the tone pre-shaping module 18 is configured for temporal shaping of the tone signal TOS depending on the shaping gains for the tone pre-shaping module 18.

According to an advantageous embodiment of the invention the shaping gains calculator for establishing shaping gains for the tone pre-shaping module 18 is configured for establishing shaping gains for the further pre-shaping module 18 depending on the control parameters CP.

FIG. 4 illustrates an advantageous embodiment of the new bandwidth extension step-by-step as an enhancement of a switched coding system. The exemplary system comprises a time domain core decoder 21 and a frequency domain core coder 22, running at an internal sampling rate of 12.8 kHz and 20 ms framing, each. This given setting results in 256 decoder output samples per frame and an output bandwidth of 6.4 kHz. By the application of the bandwidth extension, the system's effective output bandwidth is supposed to be extended up to 14.4 kHz with one noise signal, at a sampling rate of 32.0 kHz. Hence, following steps may be performed for each frame:

At the step of noise generation a noise frame of 8.0 kHz effective bandwidth (14.4 kHz-6.4 kHz) may be obtained by generating 20 ms of white noise at a sampling of 16.0 kHz, resulting in 320 noise samples.

At the step of control parameter extraction parameters from the core decoder, e.g. fundamental frequency and speech coder's long term predictor (LTP) gain may be re-used. Furthermore, parameters from core decoder output signal, e.g. spectral centroid and zero-crossing rate may be extracted. Moreover, a decision on strength of pre-shaping may be based on control parameters, e.g.: strong shaping for high fundamental frequency and high long time predictor gain (high pitched vowel) and weak or no shaping for high spectral centroid and zero-crossing rate (sibilant).

At the step of temporal envelope generation a high-pass filter may be used to remove DC part and very low frequencies from the core decoder output signal DAS, time samples may be converted to energies and linear prediction coding (LPC) coefficients may be calculated from the energies.

At the step of calculation of shaping gains linear prediction coding coefficients may be converted to frequency response of 320 samples length, which represents the smoothed temporal envelope and smooth temporal envelope samples may be converted to gain values considering targeted shaping strength.

At the step of temporal pre-shaping pre-shaping gain values may be applied to noise samples.

At the step of time-to-frequency conversion the core decoder output signal DAS may be processed by an analysis quadrature mirror filter-bank incorporating filters of 400 Hz bandwidth and 1.25 ms hop size, which results in a time-to-frequency-matrix of 20 quadrature mirror filter-subbands and 16 time slots. Furthermore, the noise frame may be processed by a further quadrature mirror filter-bank incorporating the same settings as for the decoder output signal, which results in a time-to-frequency-matrix of 16 quadrature mirror filter-subbands and 16 time slots.

At the step transposition (bandwidth selection) the noise frame may be shifted to a targeted frequency range and stack up on top of decoder signal matrix to an output T/F-matrix of 36 quadrature mirror filter-subbands and 16 time slots.

At the step of temporal and spectral post-shaping correct temporal trend for critical signal portions (e.g. transients) may be ensured by temporal post-shaping of transposed quadrature mirror filter-envelope by means of transmitted side-information. Moreover, original spectral tilt and overall energy may be approximated by spectral post-shaping of transposed quadrature mirror filter-envelope by means of transmitted side-information.

At the step of synthesizing an output time-to frequency-matrix of 36 subbands may be processed by a 40 subband synthesis quadrature mirror filter-bank, which results in a super wideband time domain output signal BAS of 32.0 kHz sampling rate and an effective bandwidth of 14.4 kHz With respect to the decoder and the methods of the described embodiments the following shall be mentioned:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, which is stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may be configured, for example, to be transferred via a data communication connection, for example via the Internet.

A further embodiment comprises a processing means, for example a computer, or a programmable logic device, configured or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCE SIGNS

1 audio decoder device
2 bitstream receiver
3 core decoder module
4 temporal envelope generator
5 bandwidth extension module
6 noise generator
7 pre-shaping module
8 time-to-frequency converter
9 time-to-frequency converter
10 combiner
11 frequency-to-time converter
12 frequency range selector
13 post-shaping module
14 further noise generator
15 further pre-shaping module
16 further time-to-frequency converter
17 tone generator
18 tone pre-shaping module
19 time-to-frequency converter
20 combiner
21 time domain core decoder
22 frequency domain core decoder
23 control parameter extractor
24 is shaping gains calculator
BS bitstream
EAS encoded audio signal
DAS decoded audio signal
TED temporal envelope
BEF frequency domain bandwidth extension signal
NOS noise signal
SNS shaped noise signal
FNS frequency domain noise signal
FDS frequency domain decoded audio signal
BFS bandwidth-extended frequency domain audio signal
BAS bandwidth-extended time domain audio signal
FSR frequency range selected frequency domain noise signal
SIS side information signal
NOSF further noise signal
SNSF further shaped noise signal
FNSF further frequency-domain noise signal
TOS tone signal
STS shaped tone signal
FTS frequency domain tone signal
SG shaping gains
CP control parameters

REFERENCES

[1] Bessette, B.; et al.: "The Adaptive Multirate Wideband Speech Codec (AMR-WB)", IEEE Transactions on Speech and Audio Processing, Vol. 10, No. 8, November 2002

[2] Dietz, M.; et al.: "Spectral Band Replication, a novel approach in audio coding", Proceedings of the 112th AES Convention, May 2002

[3] Miao, L.; et al.: "G.711.1 Annex D and G.722 Annex B—New ITU-T Super Wideband Codecs", IEEE ICASSP 2011, pp. 5232-5235

The invention claimed is:

1. An audio decoder device for decoding a bitstream, the audio decoder device comprising:

a bitstream receiver configured to receive the bitstream and to derive an encoded audio signal from the bitstream;

a core decoder module configured for deriving a decoded audio signal in time domain from the encoded audio signal;

a temporal envelope generator configured to determine a temporal envelope of the decoded audio signal;

a bandwidth extension module configured to produce a frequency domain bandwidth extension signal, wherein the bandwidth extension module comprises a noise generator configured to produce a noise signal in time domain, wherein the bandwidth extension module comprises a pre-shaping module configured for temporal shaping of the noise signal depending on the temporal envelope of the decoded audio signal in order to produce a shaped noise signal and wherein the bandwidth extension module comprises a time-to-frequency converter configured to transform the shaped noise signal into a frequency domain noise signal, wherein the frequency domain bandwidth extension signal depends on the frequency domain noise signal;

a time-to-frequency converter configured to transform the decoded audio signal into a frequency domain decoded audio signal;

a combiner configured to combine the frequency domain decoded audio signal and the frequency domain bandwidth extension signal in order to produce a bandwidth extended frequency domain audio signal; and a frequency-to-time converter configured to transform the bandwidth extended frequency domain audio signal into a bandwidth-extended time domain audio signal.

2. The audio decoder device according to claim 1, wherein the frequency domain bandwidth extension signal is produced without spectral band replication.

3. The audio decoder device according to claim 1, wherein the bandwidth extension module is configured in such way that the temporal shaping of the noise signal is done in an overemphasized manner.

4. The audio decoder device according to claim 1, wherein the bandwidth extension module is configured in such way that the temporal shaping of the noise signal is done subband-wise by splitting the noise signal into several subband noise signals by a bank of band pass filters and performing a specific temporal shaping on each of the subband noise signals.

5. The audio decoder device according to claim 1, wherein the bandwidth extension module comprises a frequency range selector configured for setting a frequency range of the frequency domain bandwidth extension signal.

6. The audio decoder device according to claim 1, wherein the bandwidth extension module comprises a post-shaping module configured for temporal and/or spectral shaping in frequency domain of the frequency domain bandwidth extension signal.

7. The audio decoder device according to claim 1, wherein the bitstream receiver is configured to derive a side information signal from the bitstream, wherein the bandwidth extension module is configured to produce the frequency domain bandwidth extension signal depending on the side information signal.

8. The audio decoder device according to claim 7, wherein the noise generator is configured to produce the noise signal depending on the side information signal.

9. The audio decoder device according to claim 7, wherein the pre-shaping module is configured for temporal shaping of the noise signal depending on the side information signal.

10. The audio decoder device according to claim 7, wherein the post-shaping module is configured for temporal and/or the spectral shaping of the frequency domain bandwidth extension signal depending on the side information signal.

11. The audio decoder device according to claim 1, wherein the bandwidth extension module comprises a further noise generator configured to produce a further noise signal in time domain, a further pre-shaping module configured for temporal shaping of the further noise signal depending on the temporal envelope of the decoded audio signal in order to produce a further shaped noise signal and a further time-to-frequency converter configured to transform the further shaped noise signal into a further frequency domain noise signal, wherein the frequency domain bandwidth extension signal depends on the further frequency domain noise signal.

12. The audio decoder device according to claim 11, wherein the bandwidth extension module is configured in such way that the temporal shaping of the further noise signal is done in an overemphasized manner.

13. The audio decoder device according to claim 11, wherein the bandwidth extension module is configured in such way that the temporal shaping of the further noise signal is done subband-wise by splitting the further noise signal into several further subband noise signals by a bank of band pass filters and performing a specific temporal shaping on each of the further subband noise signals.

14. The audio decoder device according to claim 1, wherein the bandwidth extension module comprises a tone generator configured to produce a tone signal in a time domain, a tone pre-shaping module configured for temporal shaping of the tone signal depending on the temporal envelope of the decoded audio signal in order to produce a shaped tone signal and a time-to-frequency converter configured to transform the shaped tone signal into a frequency domain tone signal, wherein the frequency domain bandwidth extension signal depends on the frequency domain tone signal.

15. The audio decoder device according to claim 1, wherein the core decoder module comprises a time domain core decoder and a frequency domain core decoder, wherein either the time domain core decoder or the frequency domain core decoder is used for deriving the decoded audio signal from the encoded audio signal.

16. The audio decoder device according to claim 15, wherein a control parameter extractor is configured for extracting control parameters used by the core decoder module from the decoded audio signal and wherein the bandwidth extension module is configured to produce the frequency domain bandwidth extension signal depending on the control parameters.

17. The audio decoder device according to claim 1, wherein the bandwidth extension module comprises a shaping gains calculator configured for establishing shaping gains for the pre-shaping module depending on the temporal envelope of the decoded audio signal and wherein the pre-shaping module is configured for temporal shaping of the noise signal depending on the shaping gains for the pre-shaping module.

18. The audio decoder device according to claim 16, wherein the shaping gains calculator for establishing shaping gains for the pre-shaping module is configured for establishing shaping gains for the pre-shaping module depending on the control parameters.

19. The audio decoder device according to claim 11, wherein the bandwidth extension module comprises a shaping gains calculator configured for establishing shaping gains for the further pre-shaping module depending on the temporal envelope of the decoded audio signal and wherein the further pre-shaping module is configured for temporal shaping of the further noise signal depending on the shaping gains for the further pre-shaping module.

20. The audio decoder device according to claim 16, wherein the shaping gains calculator for establishing shaping gains for the further pre-shaping module is configured for establishing shaping gains for the further pre-shaping module depending on the control parameters.

21. The audio decoder device according to claim 14, wherein the bandwidth extension module comprises a shaping gains calculator configured for establishing shaping gains for the tone pre-shaping module depending on the temporal envelope of the decoded audio signal and wherein the tone pre-shaping module is configured for temporal shaping of the tone signal depending on the shaping gains for the tone pre-shaping module.

22. The audio decoder device according to claim 16, wherein the shaping gains calculator for establishing shaping gains for the tone pre-shaping module is configured for establishing shaping gains for the further pre-shaping module depending on the control parameters.

23. A method for decoding a bitstream, the method comprising:

receiving the bitstream and deriving an encoded audio signal from the bitstream using a bitstream receiver;

deriving a decoded audio signal in a time domain from the encoded audio signal using a core decoder module;

determining a temporal envelope of the decoded audio signal using a temporal envelope generator;

producing a frequency domain bandwidth extension signal using a bandwidth extension module executing:

producing a noise signal in time domain using a noise generator of the bandwidth extension module, temporal shaping of the noise signal depending on the temporal envelope of the decoded audio signal in order to produce a shaped noise signal using a pre-shaping module of the bandwidth extension module, transforming the shaped noise signal into a frequency domain noise signal; wherein the frequency domain bandwidth extension signal depends on the frequency domain noise signal, using a time-to-frequency converter of the bandwidth extension module;

transforming the decoded audio signal into a frequency domain decoded audio signal using a further time-to-frequency converter;

combining the frequency domain decoded audio signal and the frequency domain bandwidth extension signal in order to produce a bandwidth extended frequency domain audio signal using a combiner; and transforming the bandwidth extended frequency domain audio signal into a bandwidth-extended time domain audio signal using a frequency-to-time converter.

24. A non-transitory digital storage medium having a computer program stored thereon to perform the method according to the preceding claim when said computer program is run by a processor.

* * * * *